United States Patent [19]

Meyers et al.

[11] Patent Number: 4,603,779

[45] Date of Patent: Aug. 5, 1986

[54] GLASSWARE PACKAGE

[75] Inventors: George Meyers; David C. Mueller, both of Ashland, Ohio

[73] Assignee: The Garber Company, Ashland, Ohio

[21] Appl. No.: 738,508

[22] Filed: May 28, 1985

Related U.S. Application Data

[63] Continuation of Ser. No. 488,535, Apr. 25, 1983, abandoned.

[51] Int. Cl.[4] ..... B65D 85/44

[52] U.S. Cl. ..... 206/426; 206/435

[58] Field of Search ..... 206/45.14, 45.19, 189, 206/194, 199, 277, 426, 427, 429, 430, 433, 434, 435, 476, 486, 490, 491; 229/28 BC, 40, 41

[56] References Cited

U.S. PATENT DOCUMENTS

| | | | |
|---|---|---|---|
| 2,781,898 | 2/1957 | Desmond et al. | 206/45.19 |
| 2,834,461 | 5/1958 | Dusseault | 229/40 |
| 2,946,433 | 7/1960 | Hennessey | 206/45.19 |
| 3,082,864 | 3/1963 | Silver | 206/45.14 |
| 3,302,778 | 2/1967 | McGorty et al. | 206/45.14 |
| 3,325,079 | 6/1967 | Puckett | 206/491 |
| 3,446,413 | 5/1969 | Sherrill et al. | 229/40 |
| 3,884,353 | 5/1975 | Forte . | |
| 3,931,888 | 1/1976 | Fogel . | |
| 4,155,445 | 5/1979 | Roccaforte | 206/486 |
| 4,155,450 | 5/1979 | Schillinger | 206/426 |
| 4,212,391 | 7/1980 | Schillinger . | |
| 4,314,640 | 2/1982 | Manizza . | |
| 4,448,308 | 5/1984 | Carver | 206/426 |

FOREIGN PATENT DOCUMENTS

| | | | |
|---|---|---|---|
| 0813192 | 5/1969 | Canada | 206/45.14 |

*Primary Examiner*—William Price
*Assistant Examiner*—Jimmy G. Foster
*Attorney, Agent, or Firm*—Yount & Tarolli

[57] ABSTRACT

A glassware package formed from a foldable blank has a top wall, a bottom wall, a pair of end walls, and an open front and back. The top and bottom walls include means for retaining a plurality of glassware items therein. Each end wall includes a flat end wall panel and a pair of support panels extending inwardly therefrom. The support panels are joined to each other at a location spaced inwardly from the end wall panel and are supported off the end wall panel. The end wall panel and support panels together form a beam-type end wall which abuts the top and bottom walls and resists relative movement of the top wall toward the bottom wall. When the blank is printed on one surface only and folded so that the printed surface forms the outer surfaces of the package, the visible sides of the support panels, and thus the insides of the end walls, are formed from the printed surface of the blank, thereby allowing the insides of the end walls to have printed matter thereon.

11 Claims, 6 Drawing Figures

GLASSWARE PACKAGE

This application is a continuation of application Ser. No. 488,535, filed 4-25-83 now abandoned.

This invention relates generally to a glassware package. Specifically, this invention relates to a glassware package and a blank which is folded to form the package. The package is adapted to retain and display items of glassware, such as drinking glasses.

BACKGROUND OF THE INVENTION

Glassware packages for displaying items of glassware such as drinking glasses generally are formed from a single sheet of foldable material which is folded to form the package. The packages include top and bottom walls interconnected by a pair of end walls. The top and bottom walls include retaining panels which are adapted to receive and retain the glassware which is to be displayed. The retaining panels have openings for receiving the glassware items and retaining them therein, while allowing a substantial portion of the glassware items to be displayed, through the open front and back of the package.

U.S. Pat. No. 4,212,391 discloses a glassware package having top and bottom walls which include panels for retaining the glassware within the package. The end walls of this package are flat planar panels which interconnect the top and bottom walls. These end panels, however, would not provide enough support to prevent the top and bottom walls from being collapsed toward each other during handling. Furthermore, the package may "tilt", that is, the top and bottom walls may move sideways relative to each other with the package flexing at the lines of connection between the end walls and the top and bottom walls. Also, the single layer end panels are susceptible to bending, which detracts from the appearance and the strength of the package.

A glassware package of the type shown in U.S. Pat. No. 4,212,391 will generally have identifying and display material on the package. The package may, for example, have a foil coating or may have a coating of ink to provide a package of a certain color. The package also will generally have information such as the names of the product and of the manufacturer printed thereon. It is desirable to be able to first perform all coating and printing on one side only of an unfolded blank, then fold the blank to form the finished package. However, if a blank as shown in U.S. Pat. No. 4,212,391 is coated or printed only on one side and folded to form the package with the coated or printed side out, then the inner sides of the end panels are formed of the uncoated or unprinted side of the blank. This does not provide as uniform an appearance as is desired and does not allow for printing on the inner sides of the end walls.

SUMMARY OF THE INVENTION

The present invention provides an improved glassware package having end walls which have a beam shape and which are interposed between the top and bottom walls for resisting relative movement of the top and bottom walls toward each other. The end walls each include an end wall panel and at least one support panel. Preferably, a pair of support panels are connected to each end wall panel. The support panels are folded inwardly from the end wall panel and are joined to each other and to the end wall panel in such a manner that the support panels are supported inwardly away from the end wall panel. The support panels abut the top and bottom walls of the package. The end walls of the package thus substantially prevent the top and bottom walls from collapsing toward each other. The end walls also have a three-dimensional configuration similar to that of the top and bottom walls, thus providing a more uniform appearance to the package.

BRIEF DESCRIPTION OF THE DRAWINGS

The foregoing and other features of the present invention will become apparent to one skilled in the art upon a consideration of the following description taken in connection with the accompanying drawings wherein.

DESCRIPTION OF A PREFERRED EMBODIMENT

Figure 1:
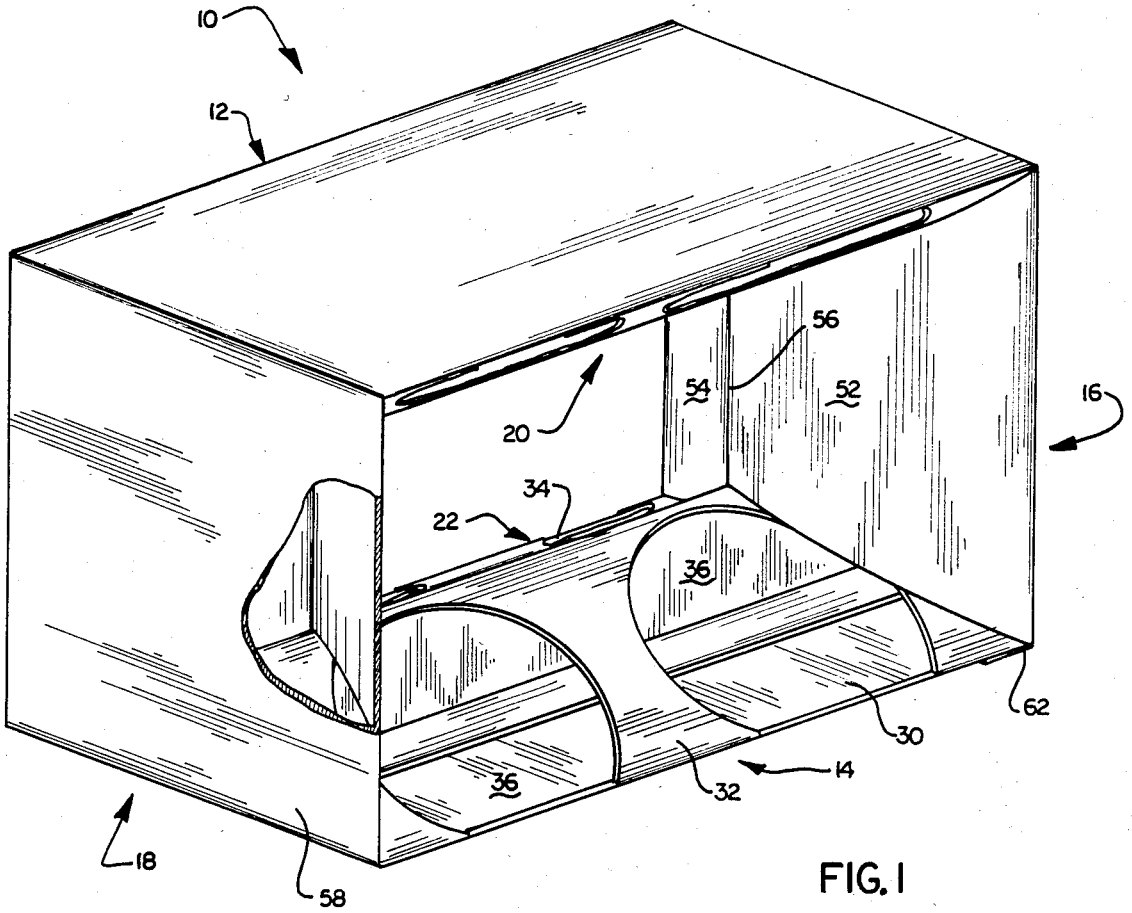
FIG. 1 is a pictorial view of a glassware package formed in accordance with the invention.

A glassware package 10 (FIG. 1) is adapted to hold a plurality of glassware items (not shown) such as cylindrical drinking glasses. The package 10 is designed to retain the glassware items securely within the package 10, while at the same time permitting a portion of each glassware item to be visible for display purposes. The package 10 as shown in the figures is adapted to contain four glassware items, such as drinking glasses, but packages may be formed in accordance with the present invention which are adapted to contain different numbers of glassware items.

The package 10 is of a generally rectangular configuration having four walls: a top wall 12, a bottom wall 14, and a pair of end walls 16 and 18. The front and back of the package 10 are open to allow the glassware items to be visible for display purposes. The end walls 16 and 18 are interposed between the top wall 12 and the bottom wall 14 and connect the top wall 12 and the bottom wall 14 to each other. The package 10 also includes retaining means 20, 22 interconnected with the top wall 12 and bottom wall 14, respectively. The glassware items to be displayed are retained in the package 10 by the retaining means 20, 22.

The bottom wall 14, to which the top wall 12 is similar, includes a bottom wall panel 30 and retaining means 22. Retaining means 22 includes a pair of inwardly extending retaining panels 32, 34. Retaining panels 32, 34 each have openings 36 therein for receiving and retaining the glassware items to be displayed. The top wall 12 is similar to the bottom wall 14, and the retaining means 20 thereon is similar to the retaining means 22 on the bottom wall 14.

The end walls 16, 18, which are similar to each other, extend between and interconnect the top wall 12 and the bottom wall 14. The end wall 16 includes a pair of support panels 52, 54 which are joined to each other approximately opposite the center of the end wall 16 along a line 56. The support panels 52, 54 abut the retaining panels 32, 34 and resist relative movement of the top wall 12 toward the bottom wall 14.

Figure 2:
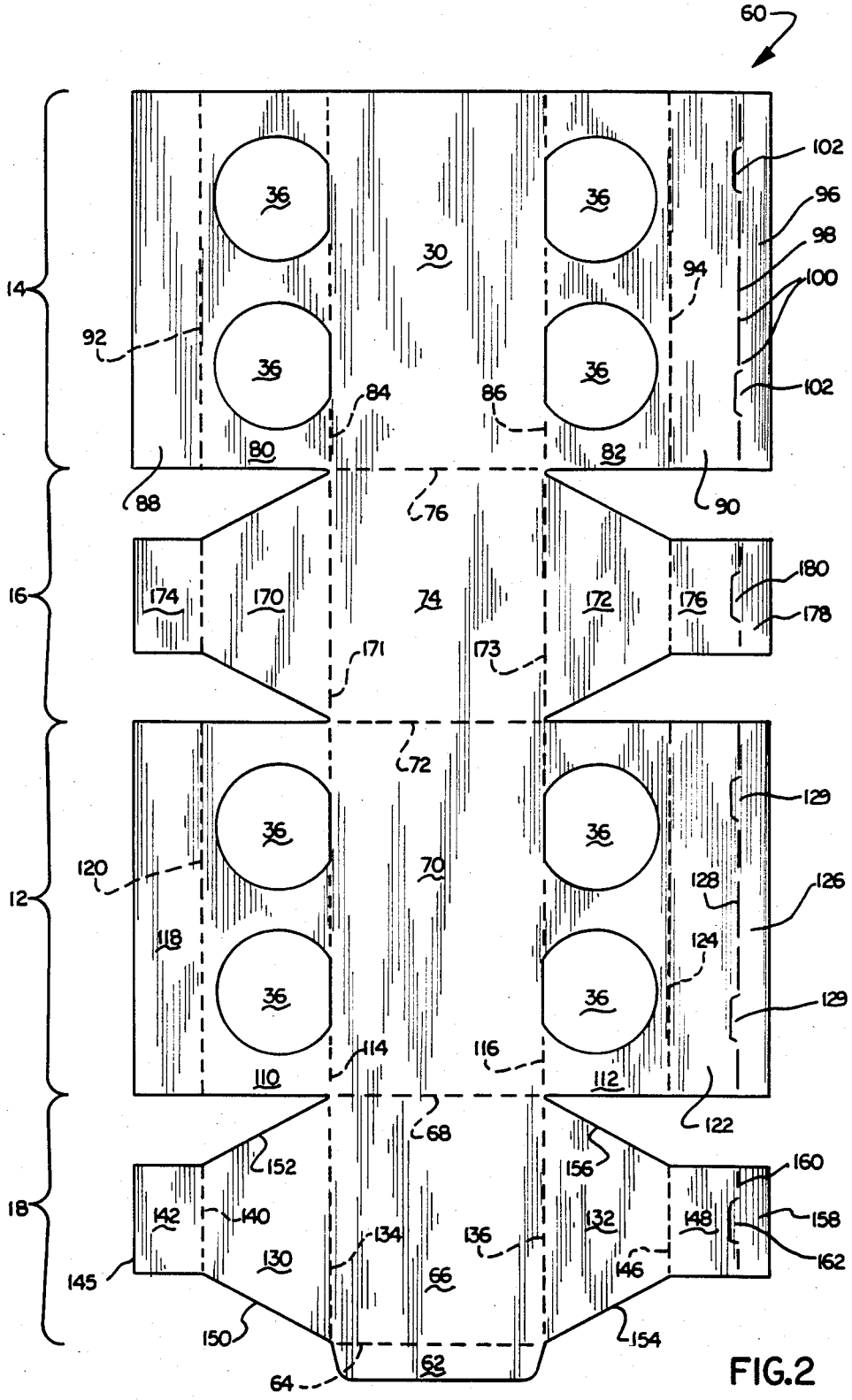
FIG. 2 is a plan view of an unfolded blank from which the package of FIG. 1 is formed.

The package of FIG. 1 is formed from a blank 60 as shown in FIG. 2. The blank 60 comprises a single sheet of foldable material such as cardboard or paperboard. Blank 60 is foldable to form the package of FIG. 1. Blank 60 is cut out in the desired shape from a sheet of cardboard or paperboard, and is scored to form score lines for folding the blank. Blank 60 may be printed on one side so that when blank 60 is folded to form the package 10 of FIG. 1, the printed side of the blank 60 is on the outside of the package 10 and is therefore the visible side of the package 10.

Blank 60 includes a series of first score lines extending transversely to the longitudinal extent of blank 60 and dividing blank 60 into a series of panels. Attachment panel 62 is connected along score line 64 to end wall panel 66. End wall panel 66 is connected along score line 68 to top wall panel 70. Top wall panel 70 is connected along score line 72 to end wall panel 74. End wall panel 74 is connected along score line 76 to bottom wall panel 30.

Bottom wall 14 as formed from blank 60 includes the bottom wall panel 30 and a pair of retaining panels 80, 82 which are connected to bottom wall panel 30 along second score lines 84, 86. Retaining panels 80, 82 each include a pair of openings 36 therein. A pair of securing panels 88, 90 are connected with the retaining panels 80, 82 along score lines 92, 94. A gluing panel 96 is connected to securing panel 90 along score line 98.

Score lines 64, 68, 72, 76, 84, 86, 92, and 94 are formed by scoring, but not cutting through the entire thickness of the blank 60. Score line 98, on the other hand, is cut through the thickness of the blank 60 along most of its length, leaving gluing panel 96 attached to securing panel 90 only at spaced apart locations 100. Score line 98 is not linear, but rather jogs to form flaps 102 which extend partially into the area of securing panel 90.

Top wall 12 is formed from blank 60 in a manner similar to bottom wall 14. Top wall 12 includes top wall panel 70, and a pair of retaining panels 110, 112 connected to top wall panel 70 along second score lines 114, 116. A securing panel 118 is connected to retaining panel 110 along score line 120, and a securing panel 122 is connected to retaining panel 112 along score line 124. A gluing panel 126 is connected along score line 128 to securing panel 122, in a manner similar to that in which gluing panel 96 is connected to securing panel 90 along score line 98.

End wall 18 (FIG. 2) as formed from blank 60 includes an endwall panel 66 and a pair of support panels 130, 132 connected to end wall panel 66 along score lines 134, 136. Support panels 130, 132 as shown in FIG. 2 are trapezoidal in shape, although it should be understood that they may be of any shape which allows them to function properly when the blank 60 is folded into the package 10. Support panel 130 is connected along a score line 140 to a securing panel 142. Support panel 132 is connected along a score line 146 to a securing panel 148. A gluing panel 158 is attached to securing panel 148 along score line 160, score line 160 being formed in a manner similar to that of score line 100, forming a flap 162 thereon.

Each support panel 130, 132 as shown in the figures has two parallel edges and two nonparallel edges. In support panel 130, score line 134 defines the longer parallel edge, and score line 140 defines the shorter parallel edge. The nonparallel edges of the support panel 130 are edges 150 and 152. Similarly, support panel 132 is defined by longer parallel edge 136 and shorter parallel edge 146, and nonparallel edges 154, 156.

End wall 16 is formed from blank 60 in a manner similar to end wall 18 and includes an end wall panel 74, a pair of support panels 170, 172 connected along third score lines 171, 173 to end wall panel 74, a pair of securing panels 174, 176, and a gluing panel 178 having a flap 180.

Figure 3:
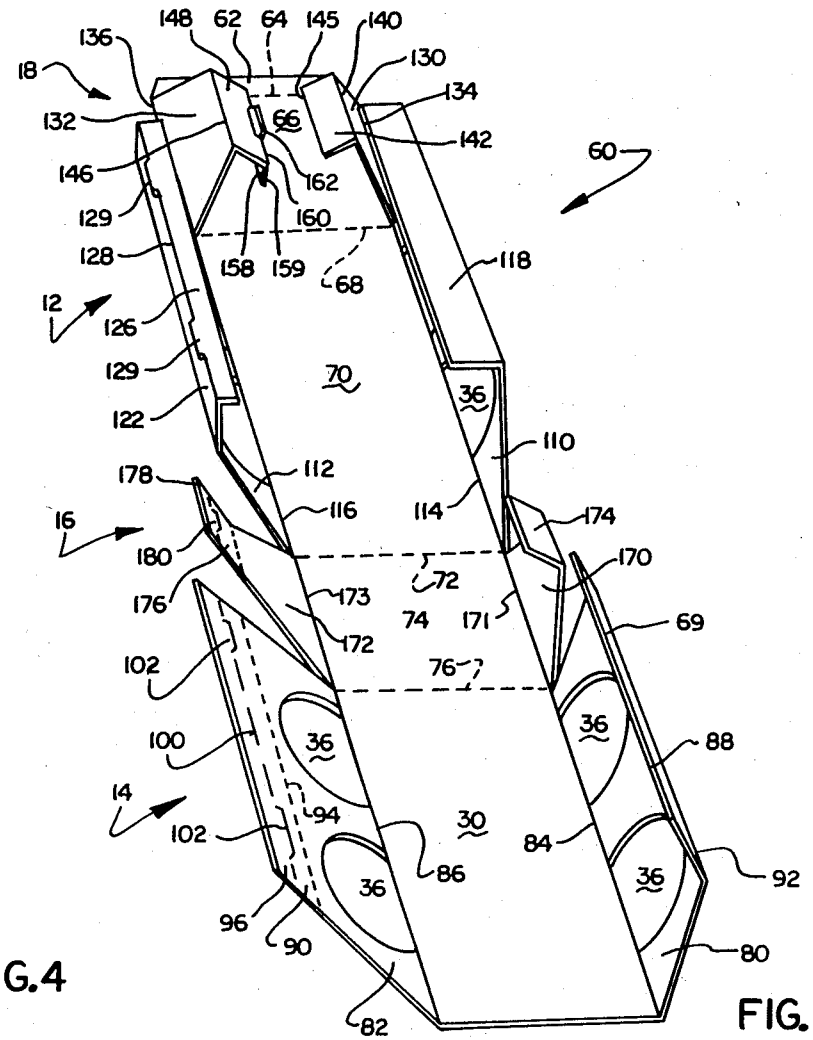
FIG. 3 is a pictorial view illustrating the blank of FIG. 2 in a partially folded position.
Figure 4:
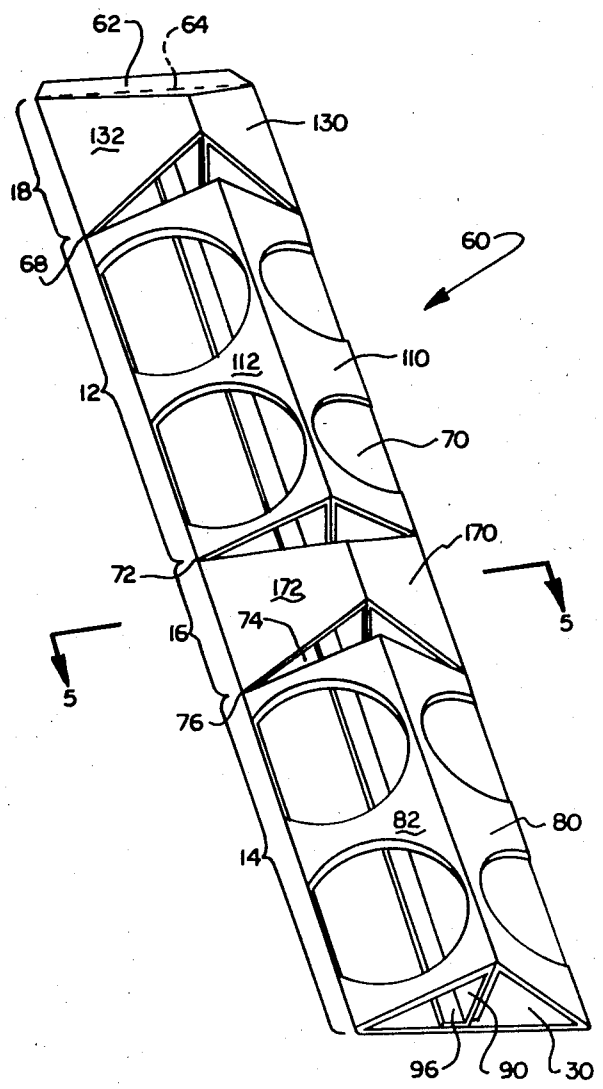
FIG. 4 is a pictorial view similar to FIG. 3 illustrating the blank of FIG. 2 in a folded position.

FIGS. 3 and 4 illustrate how the blank 60 of FIG. 2 may be folded to form the package 10 of FIG. 1. FIG. 3 illustrates various portions of the blank 60 in different partially folded positions showing how top wall 12, end wall 16, bottom wall 14, and end wall 18 are similarly formed by folding of their various component panels. As illustrated in FIG. 4, the blank 60 is ready to be folded along score lines 64, 68, 72, and 76 to form the package of FIG. 1.

In the formation of bottom wall 14, gluing panel 96, securing panel 90, and retaining panel 82 are folded about score lines 100, 94, and 86, respectively, until gluing panel 96 lies flat against bottom wall panel 30 (this can be seen more clearly in FIG. 4). Securing panel 88 and retaining panel 80 are folded about score lines 92 and 84, respectively, until securing panel 88 lies adjacent to and parallel to securing panel 90. At this point, edge 69 of securing panel 88 rests on tabs 102 of gluing panel 96. Top wall 12 is formed in a similar manner to bottom wall 14.

In the formation of end wall 18 (FIG. 3), gluing panel 158, securing panel 148, and support panel 132 are folded about score lines 160, 146, and 136, respectively, so that gluing panel 158 lies flat against end wall panel 66. At this point, flap 162 extends laterally from securing panel 148 in the plane of gluing panel 158. Securing panel 142 and support panel 130 are folded about score lines 140 and 134, respectively, so that securing panel 142 lies adjacent to and parallel to securing panel 148. At this point, edge 145 of securing panel 142 rests on tab 162. The formation of the other end wall 16 is similar to the formation of end wall 18.

Glue or another adhesive is applied to certain panels of blank 60 during the assembly process in order to secure the various panels in their final location as shown in FIG. 4. For example, in end wall 18, glue may be applied to either securing panel 142 or securing panel 148 so that the panels 142, 148 are securely joined to each other when in the position shown in FIG. 4. Also, glue is applied to surface 159 of gluing panel 158 so that gluing panel 158 is glued to end wall panel 66 by the glue on surface 159. End wall 18 is thereby securely assembled in the configuration shown in FIG. 4.

In a similar manner, on top wall 12, glue is applied to join securing panels 118, 122 when they are positioned adjacent each other, and glue is also applied to gluing panel 126 so that it may be secured to bottom panel 70. On end wall 16, glue is applied to join securing panel 174 to securing panel 176, and glue is also applied to gluing flap 178 to secure it to end wall panel 74. On bottom wall 14, glue is applied so as to secure panels 88, 90 to each other, and glue is also applied to gluing panel 96 to secure it to bottom wall panel 30.

When the gluing and folding operations are completed, the folded blank 60 will appear as shown in FIG. 4. As shown in FIG. 4, bottom wall 14 includes retaining panels 80 and 82 which are supported spaced away from bottom wall panel 30. End wall 16 includes support panels 170, 172 which are supported spaced away from end wall panel 74. Top wall 12 includes retaining panels 110 and 112 which are supported spaced away from top wall panel 70. End wall 18 includes support panels 130 and 132 which are supported spaced away from end wall panel 66.

Blank 60 as shown in FIG. 4 is then folded to form the completed package 10 shown in FIG. 1. This is done by folding the blank 60 along score lines 68, 72, and 76 so that the top wall 12, bottom wall 14, and end walls 16 and 18 are in the position shown in FIG. 1. Attachment panel 62 is folded along score line 64 and glued to the outside surface of bottom wall panel 30 to secure the entire package 10 together. The package 10 will then have the configuration shown in FIG. 1, and the glassware items to be displayed may be inserted into the package 10.

When the package 10 is assembled as shown in FIG. 1, each opening 36 on the bottom wall 14 will be aligned vertically with an opening 36 which is spaced opposite it on the top wall 12. Accordingly, a cylindrical glassware item can be disposed within a pair of the aligned openings 36 and will contact and be retained by the sides of the opening 36. Because the front and back surfaces of package 12 are open, the glassware items will be clearly visible for display purposes.

Figure 5:
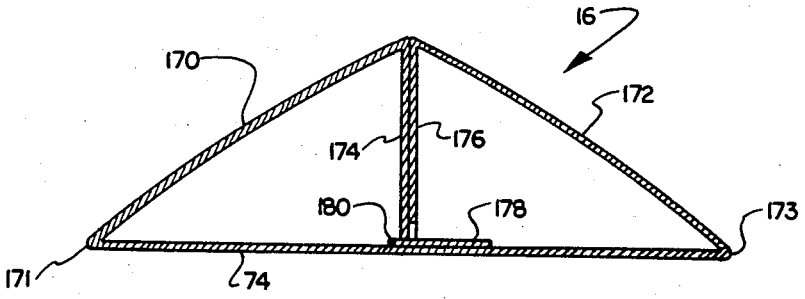
FIG. 5 is a sectional view of an end wall of the package of FIG. 1, taken along the line 5—5 of FIG. 4.

End walls 16 and 18 (FIG. 1) have a three dimensional beam configuration which resists relative movement of top wall 12 toward bottom wall 14. FIG. 5 illustrates a sectional view through end wall 16. In FIG. 5, securing panel 174 is secured by gluing to securing panel 176, and securing panel 174 rests on flap 180 of gluing panel 178 which is glued to end wall panel 74. The slightly curved shape of support panels 170, 172, which may also be seen in the package 10 illustrated in FIG. 1, results from the inherent resistance to bending of the paperboard from which the blank 60 is preferably formed. End wall 18, top wall 12, and bottom wall 14 have three-dimensional configurations in section similar to that of end wall 16 as shown in FIG. 5.

In the package 10 (FIG. 1) the end walls 16, 18 are interposed between top wall 12 and bottom wall 14. The support panels 130, 132, 170, 172 (FIG. 2) on the end walls 16, 18 abut the retaining panels 80, 82, 110, and 112 on the top wall 12 and bottom wall 14 in the manner shown in FIG. 1. The end walls 16, 18 thus form beam structures which resist relative movement of the top wall 12 and bottom wall 14 toward each other in a much more effective manner than would a thin flat end wall. The package 10 of FIG. 1 is also made more resistant to "tilting", that is, relative movement of the top wall 12 and bottom wall 14 in a direction extending between the end walls 16, 18 with pivoting along the score lines 64, 68, 72, 76. As is also shown in FIG. 1, the support panels may slightly overlap the openings 36, to provide for better retention of the glassware items in the package 10.

Figure 6:
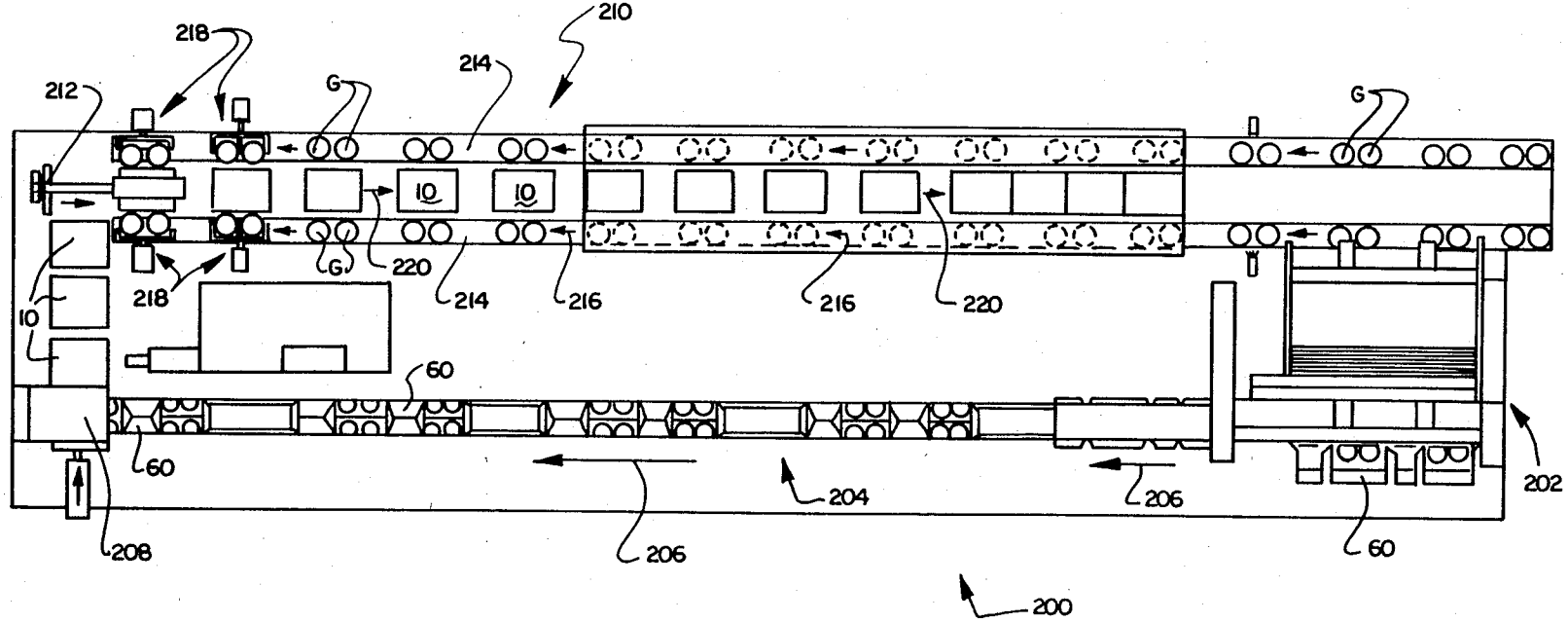
FIG. 6 is a plan view of a packaging line on which the package of FIG. 1 may be formed.

The package 10 (FIG. 1) is adapted to be assembled and filled completely by machine. The blank 60 (FIG. 2) may first be printed or coated prior to any folding operations. The blank 60 is then assembled into the package 10 and filled automatically along a packaging line 200 as shown in FIG. 6.

Packaging line 200 includes a magazine 202 which stores a plurality of blanks 60. Magazine 202 is located at one end of conveyor 204. As each blank 60 moves along conveyor 204 in the direction indicated by arrows 206, it is folded into the configuration shown in FIG. 4. The blanks 60 then enter an assembler 208 which assembles each blank 60 into a finished package 10 as shown in FIG. 1.

The finished packages 10 (FIG. 6) then move onto a conveyor 210 where they are filled with the glassware items G to be displayed in the package. Conveyor 210 includes a pusher 212 which pushes each package 10 in sequence onto the conveyor 210. Glassware items G move along the outside parts 214 of conveyor 210 in the direction shown by arrows 216. Pushers 218 automatically insert glassware items G into the package 10. The filled packages 10 then move along conveyor 210 in the direction indicated by arrows 220 and off the packaging line 200.

A further advantage of the present invention is that the inner surface of end walls 16, 18 which is visible in the completed package 10 (FIG. 1) is formed from the same surface of the blank 60 as the outer sides of the bottom wall panel 30, end wall panel 74, top wall panel 70, and end wall panel 66. This is also the same surface which forms the visible side of the retaining panels 80, 82, 110, and 112. Therefore, when an unfolded blank 60 as shown in FIG. 2 is printed or coated on one side only, and folded as described to form the package 10 of FIG. 1, the insides of the end walls 16 and 18 will be formed from the printed or coated side of the blank.

What is claimed is:

1. A package for displaying glassware, said package comprising a top wall and a bottom wall, said top and bottom walls each having retaining means for retaining the glassware within the package, and a pair of beam means interposed between said top and bottom walls for resisting relative movement of said top wall toward said bottom wall, each of said beam means comprising an end wall panel interconnected with said top and bottom walls and a pair of support panels extending inwardly of said end wall panels and abutting said retaining means, each of said support panels having first and second opposite edges, and said support panels being interconnected with opposite sides of said end wall panel along first edges of said support panels and being secured to each other adjacent second edges thereof at a location spaced apart from said end wall panel, said beam means including means for securing said support panels to each other, said securing means comprising a pair of securing panels each attached to a respective support panel at the second edge thereof, and means for securing said support panels to said end wall panel at a location spaced inwardly along said end wall panel and for supporting said support panels in a position spaced inwardly from said end wall panel, said means for securing said support panels to said end wall panel comprising a panel attached to one of said securing panels.

2. A package as set forth in claim 1 wherein said securing panels at least partially abut each other and extend substantially transverse to said end wall panel.

3. A package as set forth in claim 1 wherein said top wall comprises a top wall panel interconnected with said end wall panels, said bottom wall comprises a bottom wall panel interconnected with said end wall panels, said retaining means is interconnected with and extends inwardly of said top wall panel and said bottom wall panel, and said support panels abut said retaining means at locations spaced apart inwardly from said top and bottom wall panel and inwardly from said end wall panel.

4. A packeage as set forth in claim 3 wherein said package is formed from a foldable blank which is folded into said package, said blank having a first side and a second side, said first side including those sides of said support panels and said end wall panels which are substantially visible when said blank is folded into said package.

5. A package as set forth in claim 1 wherein each of said support panels comprises a generally trapezoidal panel having opposite a longer parallel edge and a shorter parallel edge and two nonparallel edges, said trapezoidal panels being interconnected with said end wall panel along said longer parallel edges and being secured to each other along said shorter parallel edges.

6. A package as set forth in claim 5 wherein said support panels abut said retaining means along said nonparallel edges of said trapezoidal panels.

7. A blank which is foldable into a package for displaying glassware, the package having top and bottom walls and a pair of end walls, said blank comprising a longitudinally extending sheet of foldable material having a series of first score lines extending transversely to the longitudinal extent of said sheet and defining a series of panels comprising a bottom wall panel, a first end wall panel, a top wall panel, a second end wall panel, and an attachment panel, said sheet further including a pair of retaining panels foldably interconnected to opposite sides of each of said top and bottom wall panels along second score lines extending generally perpendicularly to said first score lines, each of said retaining panels including means defining openings for receiving and retaining the glassware, a plurality of support panels each foldably interconnected to each one of said end wall panels along one of a series of third score lines on opposite sides of each of said end wall panels, said support panels being foldable inwardly along said third score lines and being sized abut said retaining panels and to abut each other along sides of said support panels opposite from said end wall panels when said blank is folded into the package to form with said end wall panels a pair of beam means interposed between said top and bottom walls for resisting relative movement of said top wall toward said bottom wall, a plurality of securing panels each foldably interconnected with each of said support panels along a side of said support panels opposite from said end wall panels and sized to secure said support panels to said end wall panels at a location spaced inwardly along said end wall panels from said support panels and adapted to support said supoort panels in a position spaced inwardly from said end wall panels to form said beam means, when said blank is folded into the package, and a plurality of panels for securing said securing panels to respective end walls.

8. A blank as set forth in claim 7 wherein said retaining panels extend inwardly of said top and bottom wall panels when said blank is folded into the package, and said support panels abut said retaining panels at locations spaced inwardly from said top and bottom wall panels and inwardly from said end wall panels.

9. A blank as set forth in claim 8 wherein said sheet of foldable material has a first side and a second side, and wherein that side of each of said end wall panels which is on the outside of the package when the blank is folded into the package is formed from said first side of said sheet, and that side of each of said support panels which is on the outside of the package when the blank is folded into the package is formed from said first side of said sheet.

10. A blank as set forth in claim 7 wherein each of said support panels comprises a generally trapezoidal panel having a longer parallel edge and a shorter parallel edge and two nonparallel edges, each of said trapezoidal panels being foldably interconnected with said end wall panels along said longer parallel edges.

11. A blank as set forth in claim 10 wherein said securing panels are foldably interconnected with said support panels along said shorter parallel edges.

* * * * *